US008374520B2

(12) United States Patent
Inukai

(10) Patent No.: US 8,374,520 B2
(45) Date of Patent: Feb. 12, 2013

(54) IMAGE FORMING APPARATUS

(75) Inventor: Katsumi Inukai, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 433 days.

(21) Appl. No.: 12/692,474

(22) Filed: Jan. 22, 2010

(65) Prior Publication Data

US 2010/0189457 A1 Jul. 29, 2010

(30) Foreign Application Priority Data

Jan. 23, 2009 (JP) ..... 2009-013329

(51) Int. Cl.
*G03G 15/16* (2006.01)

(52) U.S. Cl. ..... 399/66

(58) Field of Classification Search ..... 399/66, 399/121, 314, 315

See application file for complete search history.

(56) References Cited

U.S. PATENT DOCUMENTS

| | | | | |
|---|---|---|---|---|
| 2009/0052923 | A1 | 2/2009 | Inukai | |
| 2009/0169230 | A1* | 7/2009 | Deguchi et al. | 399/66 |
| 2009/0202265 | A1 | 8/2009 | Inukai | |

FOREIGN PATENT DOCUMENTS

| | | | |
|---|---|---|---|
| JP | H08-115000 | A | 5/1996 |
| JP | H09-160402 | A | 6/1997 |
| JP | H11-298717 | A | 10/1999 |
| JP | 2006-276471 | A | 10/2006 |
| JP | 2009-048103 | A | 3/2009 |

OTHER PUBLICATIONS

Japan Patent Office, Notification of Reason for Refusal for Japanese Patent Application No. 2009-013329, dispatched Jun. 14, 2011.
Japan Patent Office Notification of Reason for Refusal for Patent Application No. JP 2009-013329, dispatched Nov. 25, 2010.

* cited by examiner

*Primary Examiner* — Walter L Lindsay, Jr.
*Assistant Examiner* — Barnabas Fekete
(74) *Attorney, Agent, or Firm* — Baker Botts L.L.P.

(57) ABSTRACT

An image forming apparatus includes: an image carrying unit; a charging unit; a transfer unit transferring an developed image to a recording medium in accordance with application of a transfer voltage; an application unit generating the transfer voltage and applying the transfer voltage to the transfer unit; a voltage detection unit detecting the transfer voltage; an inflow current detection unit detecting an inflow current flowing from the image carrying unit charged by the charging unit into the application unit; a transfer current detection unit detecting a transfer current flowing when the transfer voltage is applied to the transfer unit; a determination unit determining an initiating voltage which induces the inflow current; a calculation unit calculating load resistance of the application unit based on the transfer voltage, the transfer current, and the initiating voltage; and an adjustment unit that adjusts the transfer current in accordance with the load resistance.

9 Claims, 10 Drawing Sheets

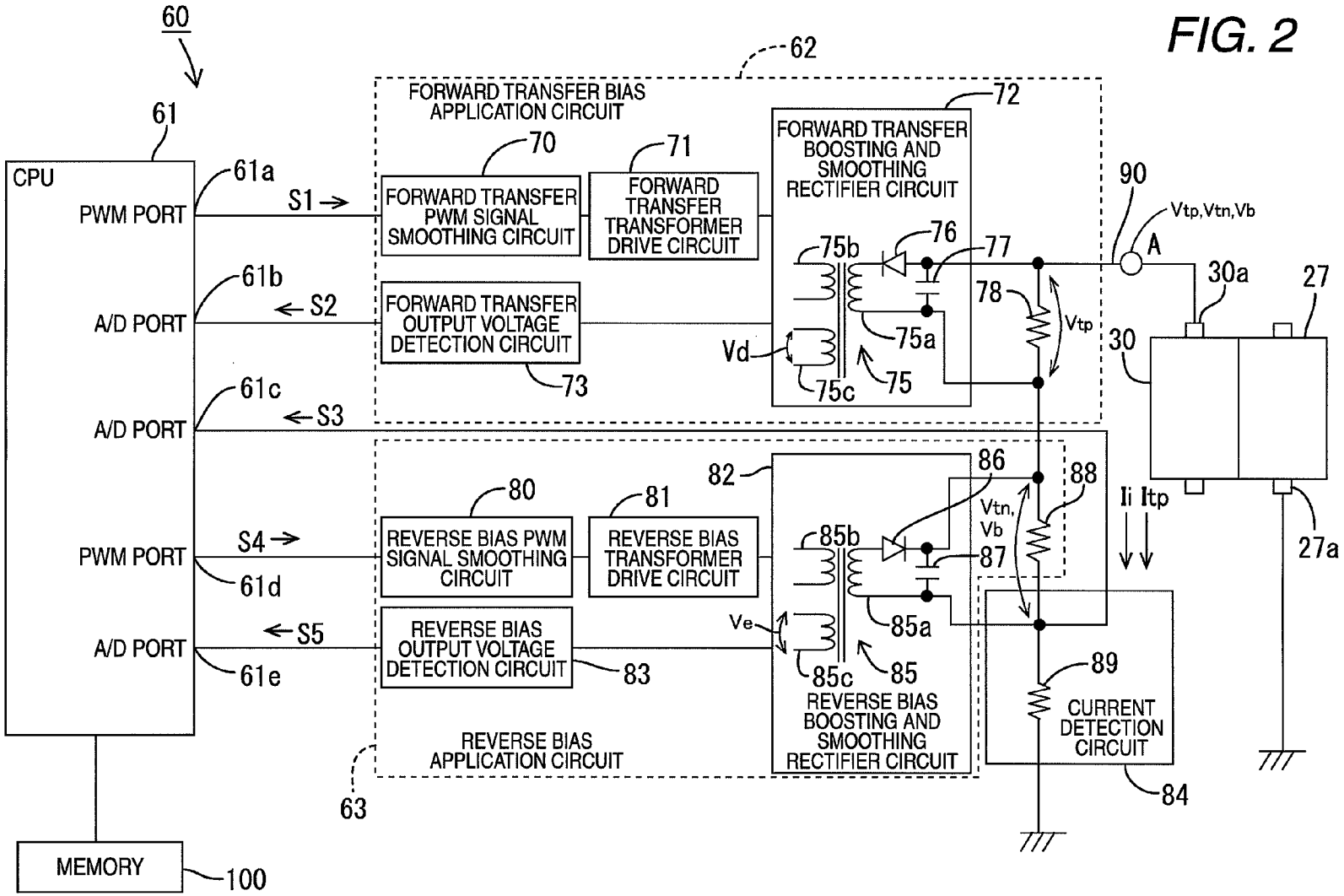
FIG. 2
60
61
CPU
PWM PORT
A/D PORT
A/D PORT
PWM PORT
A/D PORT
61a
61b
61c
61d
61e
S1
S2
S3
S4
S5
MEMORY
100
62
63
FORWARD TRANSFER BIAS APPLICATION CIRCUIT
FORWARD TRANSFER PWM SIGNAL SMOOTHING CIRCUIT
FORWARD TRANSFER TRANSFORMER DRIVE CIRCUIT
FORWARD TRANSFER OUTPUT VOLTAGE DETECTION CIRCUIT
FORWARD TRANSFER BOOSTING AND SMOOTHING RECTIFIER CIRCUIT
REVERSE BIAS PWM SIGNAL SMOOTHING CIRCUIT
REVERSE BIAS TRANSFORMER DRIVE CIRCUIT
REVERSE BIAS OUTPUT VOLTAGE DETECTION CIRCUIT
REVERSE BIAS BOOSTING AND SMOOTHING RECTIFIER CIRCUIT
REVERSE BIAS APPLICATION CIRCUIT
CURRENT DETECTION CIRCUIT
70
71
72
73
75
75a
75b
75c
76
77
78
80
81
82
83
84
85
85a
85b
85c
86
87
88
89
90
27
27a
30
30a
A
Vtp,Vtn,Vb
Vtp
Vtn,
Vb
Vd
Ve
Ii Itp

IMAGE FORMING APPARATUS

CROSS REFERENCE TO RELATED APPLICATION

The present application claims priority from Japanese Patent Application No. 2009-013329, which was filed on Jan. 23, 2009, the disclosure of which is herein incorporated by reference in its entirety.

TECHNICAL FIELD

The apparatuses and devices consistent with the present invention relate to an image forming apparatus, and in particular, to adjustment of a transfer current.

BACKGROUND

According to a related art electro-photographic image forming apparatus, when an image formed on a photosensitive member (image carrying unit) is transferred to a sheet, adjustment is made such that a suitable transfer current flows between the photosensitive member and a transfer unit, for example, a transfer roller. In order to appropriately adjust the transfer current, it is necessary to accurately calculate load resistance of an application unit that applies a transfer voltage to the transfer roller.

The above described related art image forming apparatus discloses a technique to measure load resistance accurately. For example, according to the above technique, when a predetermined voltage is applied and a current is measured immediately after a recording medium enters the transfer roller, a leak current is measured at a portion, such as a sheet feed roller. And then, a current actually flowing in the transfer roller is calculated on the basis of the measurement result, thereby measuring accurate load resistance.

SUMMARY

However, the related art image forming apparatus has not discussed a leak current (hereinafter, referred to as "inflow current") leaking from the photosensitive member into the transfer roller. In general, the photosensitive member is charged before the transfer roller is activated, so an inflow current may be generated from the charged photosensitive member to the application circuit through the transfer roller. This inflow current hinders calculation of accurate load resistance of the application unit, and as a result, a suitable transfer current may not flow.

It is an object of the invention to provide an image forming apparatus capable of adjusting a suitable transfer current even when an inflow current is generated from an image carrying unit to a transfer voltage application unit.

According to an illustrative aspect of the present invention, there is provided an image forming apparatus comprising: an image carrying unit that carries an image developed by a developer; a charging unit that charges the image carrying unit; a transfer unit that transfers the image to a recording medium in accordance with application of a transfer voltage; an application unit that generates the transfer voltage and applies the transfer voltage to the transfer unit; a voltage detection unit that detects the transfer voltage; an inflow current detection unit that detects an inflow current flowing from the image carrying unit charged by the charging unit into the application unit; a transfer current detection unit that detects a transfer current flowing when the transfer voltage is applied to the transfer unit; a determination unit that determines an initiating voltage which induces the inflow current; a calculation unit that calculates load resistance of the application unit based on the transfer voltage detected by the voltage detection unit, the transfer current detected by the transfer current detection unit, and the initiating voltage determined by the determination unit; and an adjustment unit that adjusts the transfer current in accordance with the load resistance calculated by the calculation unit.

Further, according to another illustrative aspect of the present invention, there is provided an image forming apparatus comprising: an image carrying unit that carries an image developed by a developer; a charging unit that charges the image carrying unit; a transfer unit that transfers the image to a recording medium in accordance with application of a transfer voltage; an application unit that generates the transfer voltage and applies the transfer voltage to the transfer unit; a voltage detection unit that detects the transfer voltage; an inflow current detection unit that detects an inflow current flowing from the image carrying unit charged by the charging unit into the application unit; a transfer current detection unit that detects a transfer current flowing when the transfer voltage is applied to the transfer unit; a reverse voltage application unit that applies a reverse voltage having a polarity opposite to the transfer voltage to the transfer unit; a control unit that controls the reverse voltage application unit so as to gradually increase the reverse voltage when the inflow current is equal to or larger than a predetermined value in a state where the recording medium is not fed between the image carrying unit and the transfer unit, and when the inflow current becomes smaller than the predetermined value as the reverse voltage increases, the control unit controls the reverse voltage application unit so as to maintain a state where the reverse voltage is applied; a calculation unit that calculates load resistance of the application unit based on the transfer voltage detected by the voltage detection unit and the transfer current detected by the transfer current detection unit, the calculation unit calculating the load resistance in a state where the reverse voltage is applied by the control unit such that the inflow current becomes smaller than the predetermined value; and an adjustment unit that adjusts the transfer current in accordance with the load resistance calculated by the calculation unit.

According to the above describe illustrative aspects, even when an inflow current from the image carrying unit to the transfer voltage application unit is present, suitable transfer current adjustment can be performed.

BRIEF DESCRIPTION OF THE DRAWINGS

Illustrative aspects of the invention will be described in detail with reference to the following figures wherein:

FIG. 2 is a block diagram showing the configuration of main parts of a bias application circuit according to a first embodiment of the invention;

DETAILED DESCRIPTION OF EXEMPLARY EMBODIMENTS OF THE PRESENT INVENTION

First Embodiment

A first embodiment of the invention will be described with reference to FIGS. 1 to 4.

1. Overall Configuration of Image Forming Apparatus

Figure 1:
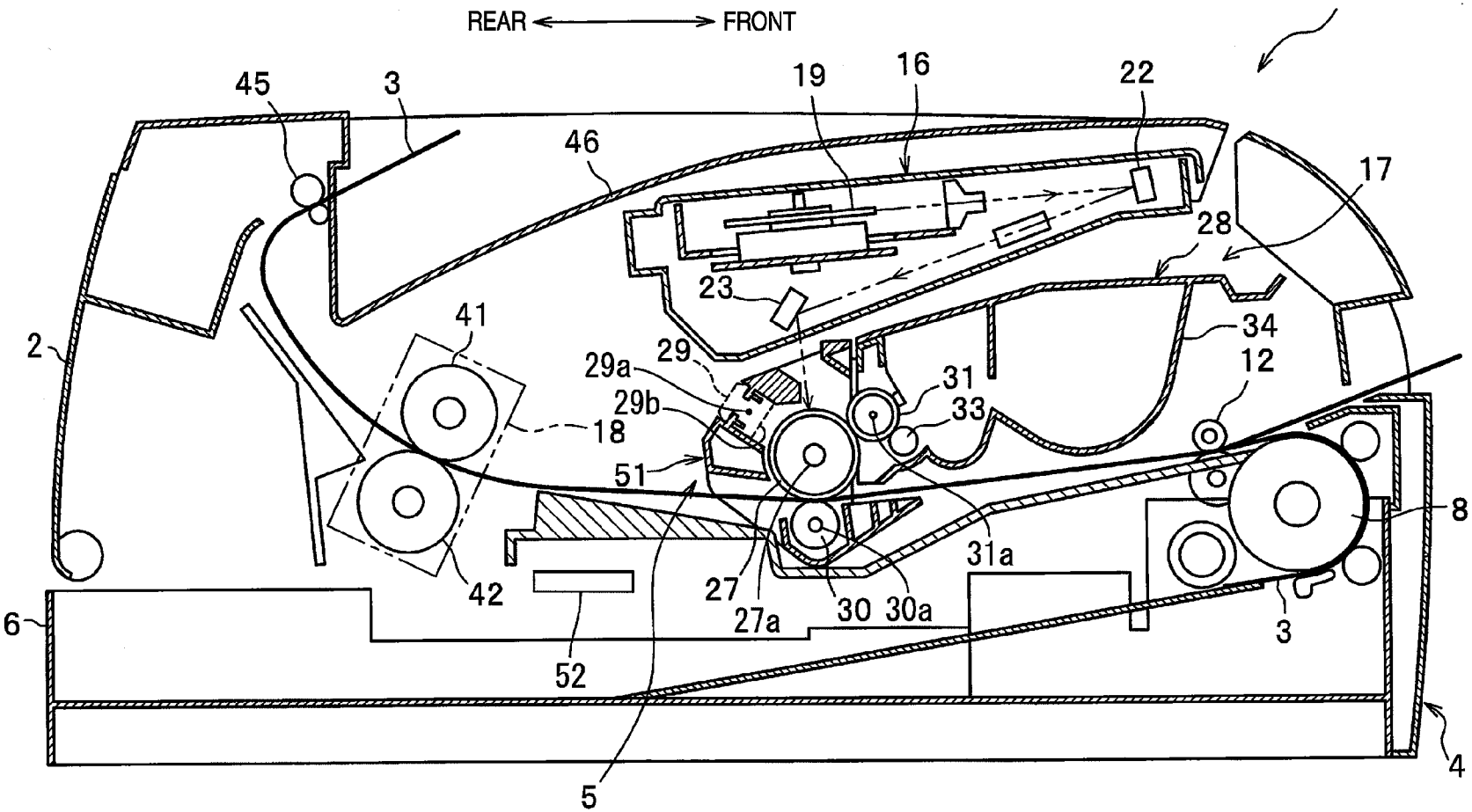
FIG. 1 is a side sectional view showing the internal configuration of a laser printer according to an embodiment of the invention.

FIG. 1 is a schematic side sectional view showing main parts of a laser printer of this embodiment as an image forming apparatus of the invention. In FIG. 1, the laser printer 1 includes, in a main body frame 2 as a main body of an image forming apparatus, a feeder unit 4 feeding a sheet (an example of a recording medium) 3, an image forming unit 5 forming an image on the fed sheet 3, and the like. The term "image forming apparatus" refers not only to a laser printer, but also to an LED printer, a facsimile machine, or a multifunctional apparatus equipped with a copy function and a scanner function.

(1) Feeder Unit

The feeder unit 4 is provided at the bottom of the main body frame 2, and includes a sheet feed tray 6, a sheet feed roller 8 provided above one end side of the sheet feed tray 6 (hereinafter, one end side (a right side in FIG. 1) is referred to as a front side, and an opposite side (a left side in FIG. 1) is referred to as a rear side), a registration roller 12 provided on a downstream side in a transport direction of the sheet 3 with respect to the sheet feed roller 8, and the like.

An uppermost sheet 3 in the sheet feed tray 6 is fed one by one by rotation of the sheet feed roller 8. The fed sheet 3 is delivered to the registration roller 12. The registration roller 12 performs registration for the sheet 12 and sends the sheet 3 to an image forming position. The image forming position is a contact position (nip portion) between a photosensitive drum 27 and the transfer roller 30.

(2) Image Forming Unit

The image forming unit 5 includes a scanner unit 16, a process cartridge 17, and a fixing unit 18.

The scanner unit 16 is provided at the upper part of the main body frame 2, and includes a laser light-emission unit (not shown), a polygon mirror 19, a reflecting mirror 22 and 23, and the like. A laser beam based on image data emitted from the laser light-emission unit is irradiated onto the surface of the photosensitive drum 27 through the polygon mirror 19, the reflecting mirrors 22 and 23, and the like by high-speed scanning.

The process cartridge 17 is provided below the scanner unit 16, and includes a drum unit 51, and a developing cartridge 28 accommodated in the drum unit 51. The developing cartridge 28 is accommodated so as to be freely attached/detached with respect to the drum unit 51, and includes, for example, a developing roller 31, a supply roller 33, a toner hopper 34, and the like.

In the toner hopper 34, for example, positively chargeable toner (an example of a developer) is filled. The supply roller 33 is provided at the back of the toner hopper 34, and the developing roller 31 having a metallic roller shaft 31*a* is provided facing the supply roller 33. At the time of development, a predetermined developing bias voltage is applied to the roller shaft 31*a*. Toner discharged from the toner hopper 34 is supplied to the developing roller 31 by rotation of the supply roller 33 and positively frictionally charged between the supply roller 33 and the developing roller 31.

The drum unit 51 includes a photosensitive drum (an example of an image carrying member) 27, a Scorotron-type charger (an example of a charging unit) 29, a transfer roller 30 (an example of a transfer unit), and the like. The photosensitive drum 27 is arranged facing the developing roller 31, and includes a cylindrical drum main body and a grounded metallic drum shaft 27*a* at the shaft center of the drum main body. A positively chargeable photosensitive layer is formed on the surface of the drum main body. An exposure window serving as a passage of a laser beam is provided above the photosensitive drum 27.

The Scorotron-type charge (hereinafter, simply referred to as "charger") 29 is arranged above the photosensitive drum 27 so as to be not in contact with the photosensitive drum 27 and to face the photosensitive drum 27 at a predetermined gap. The charger 29 includes a charging wire 29*a* and a grid 29*b*, and positively (for example, about 870 V) charges the surface of the photosensitive drum 27 uniformly through the grid 29*b* by discharge from the charging wire 29*a*. A predetermined charging voltage (for example, 5 kV to 8 kV) is applied to the charging wire 29*a*.

The surface of the photosensitive drum 27 is positively charged uniformly by the charger 29 in accordance with rotation of the photosensitive drum 27. Thereafter, the charged surface is exposed by high-speed scanning of the laser beam from the scanner unit 16, and an electrostatic latent image based on image data is formed. Next, positively charged toner on the surface of the developing roller 31 is supplied to the electrostatic latent image on the surface of the photosensitive drum 27 by rotation of the developing roller 31, and the electrostatic latent image is developed.

The transfer roller 30 has a metallic roller shaft 30*a*, and is arranged facing the photosensitive drum 27 below the photosensitive drum 27. The roller shaft 30*a* is covered with a roller made of a conductive rubber material, for example.

As shown in FIG. 2, a bias application circuit 60 mounted on a circuit board 52 is connected to the roller shaft 30*a* of the transfer roller 30. During a transfer operation in which a toner image formed on the developing roller 31 is transferred to the sheet 3 at a transfer position, for example, a forward transfer bias voltage (transfer voltage) Vtp of about −6 kV is applied from the bias application circuit 60 to the roller shaft 30*a* of the transfer roller 30.

In this embodiment, before or after an image forming operation, or during the transfer operation to the sheet 3 of the image forming operation, for example, a residual toner removing reverse bias voltage Vtn of 600 V having a polarity opposite to the forward transfer bias voltage Vtp is applied from the bias application circuit 60 to the transfer roller 30. Thus, toner stuck to the transfer roller 30 is electrically ejected onto the photosensitive drum 27, and is collected by the developing roller 31, together with residual toner on the surface of the photosensitive drum 27.

As shown in FIG. 1, the fixing unit 18 is provided on a downstream side at the back of the process cartridge 17, and includes a heating roller 41 and a pressing roller 42 pressing the heating roller 41. The fixing unit 18 thermally fixes toner transferred onto the sheet 3 while the sheet 3 passes through between the heating roller 41 and the pressing roller 42. Thereafter, the sheet 3 is delivered to a sheet discharge roller 45 and discharged onto a sheet discharge tray 46 by the sheet discharge roller 45.

2. Bias Application Circuit

Next, a bias application circuit will be described with reference to FIG. 2. FIG. 2 is a block diagram showing the configuration of main parts of the bias application circuit 60 that applies the transfer voltage Vtp to the transfer roller 30.

As described above, the bias application circuit 60 applies the forward transfer bias voltage Vtp to the transfer roller 30 during a forward transfer operation. Meanwhile, at the time of residual toner removal, the bias application circuit 60 applies the reverse bias voltage Vtn. The bias application circuit 60 applies a reverse bias voltage Vb so as to determine an initiating voltage Vx which induces an inflow current Ii described below or to calculate load resistance Zr in a state where the initiating voltage Vx is negated.

The bias application circuit 60 includes a CPU (an example of a determination unit, a calculation unit, and an adjustment unit) 61, a forward transfer bias application circuit (an example of an application unit) 62 generating the forward transfer bias voltage Vtp, a reverse bias application circuit (an example of a reverse voltage application unit) 63 generating the reverse bias voltage (Vtn and Vb). The bias application circuits 62 and 63 are connected in series to a connection line 90 connected to the roller shaft 30*a* of the transfer roller 30 in an order of the forward transfer bias application circuit 62 and the reverse bias application circuit 63. The CPU 61 controls the respective units of the printer 1 related to image formation, as well as the bias application circuit 60.

The bias application circuit 60 includes a current detection circuit (an example of an inflow current detection unit and a transfer current detection unit) 84 outputting a detection signal S3 corresponding to a current value flowing in the connection line 90. The bias application circuit 60 also includes a circuit for applying other high voltage, for example, a charging voltage, which is not shown in the drawings. The bias application circuit 60 and the CPU 61 are arranged on the circuit board 52 shown in FIG. 1.

The forward transfer bias application circuit 62 is constant-current-controlled under the PWM (Pulse Width Modulation) control of the CPU 61, and the reverse bias application circuit 63 is constant-voltage-controlled under the PWM control of the CPU 61. A memory 100 is connected to the CPU 61. The memory 100 stores a program for controlling the bias application circuit 60, an initial value (reference value) of a transfer current Itp, various kinds of table data, and the like.

(a) Forward Transfer Bias Application Circuit

The forward transfer bias application circuit 62 is a high voltage (negative voltage) generation circuit, and includes a forward transfer PWM signal smoothing circuit 70, a forward transfer transformer drive circuit 71, a forward transfer boosting and smoothing rectifier circuit 72, and a forward transfer output voltage detection circuit (an example of a voltage detection unit) 73.

The forward transfer PWM signal smoothing circuit 70 smoothes a PWM signal S1 from a PWM port 61*a* of the CPU 61, and sends the smoothed PWM signal S1 to the forward transfer transformer drive circuit 71. The forward transfer transformer drive circuit 71 feeds an oscillation current to a primary-side winding 75*b* of the forward transfer boosting and smoothing rectifier circuit 72 on the basis of the smoothed PWM signal S1.

The forward transfer boosting and smoothing rectifier circuit 72 includes a transformer 75, a diode 76, a smoothing capacitor 77, and the like. The transformer 75 includes a secondary-side winding 75*a*, a primary-side winding 75*b*, and an auxiliary winding 75*c*. One end of the secondary-side winding 75*a* is connected to a connection line 90 through the diode 76. The other end of the secondary-side winding 75*a* is connected in common to an output terminal of the reverse bias application circuit 63. The smoothing capacitor 77 and a resistor 78 are connected in parallel to the secondary-side winding 75*a*.

With this configuration, the forward transfer boosting and smoothing rectifier circuit 72 boosts and rectifies the voltage in the primary-side winding 75*b* and applies the resultant voltage as the forward transfer bias voltage Vtp to the roller shaft 30*a* of the transfer roller 30 connected to an output terminal A of the bias application circuit 60.

The forward transfer output voltage detection circuit 73 is connected to the auxiliary winding 75*c* of the transformer 75 of the forward transfer boosting and smoothing rectifier circuit 72 and the CPU 61. During the forward transfer operation by the forward transfer bias application circuit 62, the forward transfer output voltage detection circuit 73 detects an output voltage Vd generated across the auxiliary winding 75*c*, and supplies a detection signal S2 to an A/D port 61*b* of the CPU 61. The CPU 61 detects a forward transfer output voltage Vtp on the basis of the detection signal S2.

(b) Reverse Bias Application Circuit

The reverse bias application circuit 63 is a high voltage (positive voltage) generation circuit, similarly to the forward transfer bias application circuit 62, and includes a reverse bias PWM signal smoothing circuit 80, a reverse bias transformer drive circuit 81, a reverse bias boosting and smoothing rectifier circuit 82, and a reverse bias output voltage detection circuit 83.

The reverse bias PWM signal smoothing circuit 80 smoothes a PWM signal S4 from a PWM port 61*d* of the CPU 61, and supplies the smoothed PWM signal S4 to the reverse bias transformer drive circuit 81. The reverse bias transformer drive circuit 81 feeds an oscillation current to the primary-side winding 85*b* of the reverse bias boosting and smoothing rectifier circuit 82 on the basis of the smoothed PWM signal S4.

The reverse bias boosting and smoothing rectifier circuit 82 includes a transformer 85, a diode 86, a smoothing capacitor 87, and the like. The transformer 85 includes a secondary-side winding 85*a*, a primary-side winding 85*b*, and an auxiliary winding 85*c*. One end of the secondary-side winding 85*a* is connected to the other end of the secondary-side winding 75*a* of the forward transfer bias application circuit 62 through the diode 86. The other end of the secondary-side winding 85*a* is grounded through a detection resistor 89 of the current detection circuit 84. The smoothing capacitor 87 and a resistor 88 are connected in parallel to the secondary-side winding 85*a*. The detection resistor 89 connected in series to the resistor 88 serves as a current detection resistor, and the detection signal (voltage value) S3 corresponding to a current value flowing in the detection resistor 89 is fed back to an A/D port 61*c* of the CPU 61.

With this configuration, the reverse bias boosting and smoothing rectifier circuit 82 boosts and rectifies the voltage in the primary-side winding 85*b*, and applies the resultant voltage as the residual toner removing reverse bias voltage Vtn to the roller shaft 30*a* of the transfer roller 30 connected to the output terminal A of the bias application circuit 60. An output voltage of the reverse bias application circuit 63 is applied to the transfer roller 30 as the reverse bias voltage Vb for determining the initiating voltage Vx or negating the initiating voltage Vx.

The reverse bias output voltage detection circuit 83 is connected to the auxiliary winding 85*c* of the transformer 85 of the reverse bias boosting and smoothing rectifier circuit 82 and the CPU 61. During the reverse bias operation by the reverse bias application circuit 63, the reverse bias voltage detection circuit 83 detects an output voltage Ve generated across the auxiliary winding 85*c*, and supplies a detection signal S5 to an A/D port 61*e* of the CPU 61. The CPU 61 detects a reverse bias output voltage (Vtn, Vb) on the basis of the detection signal S5.

With the above-described configuration, during the forward transfer operation, the CPU 61 executes constant-current control to supply the PWM signal S1 to the forward transfer bias application circuit 62 so as to drive the forward transfer bias application circuit 62, and to output the PWM signal S1 with a duty ratio appropriately changed to the forward transfer PWM signal smoothing circuit 70 on the basis of the detection signal S3 corresponding to the current value flowing in the connection line 90 such that the current value becomes a transfer target current value.

During the reverse bias operation, the CPU 61 executes constant-voltage control to supply the PWM signal S4 to the reverse bias application circuit 63 so as to drive the reverse bias application circuit 63, and to output the PWM signal S4 with a duty ratio appropriately changed to the reverse bias PWM signal smoothing circuit 80 on the basis of the detection signal S5 of the reverse bias output voltage detection circuit 83 such that the reverse bias voltage (Vtn and Vb) has a predetermined constant voltage value.

During the reverse bias operation, the detection signal (voltage signal) S3 from the current detection circuit may be fed back so as to control the reverse bias voltage (Vtn and Vb). That is, the current detection circuit 84 may be used for detection of the forward transfer bias voltage Vtp and the reverse bias voltage (Vtn, Vb), as well as detection of the transfer current Itp and the inflow current Ii.

3. Load Resistance Calculation and Transfer Current Adjustment

Figure 4A:
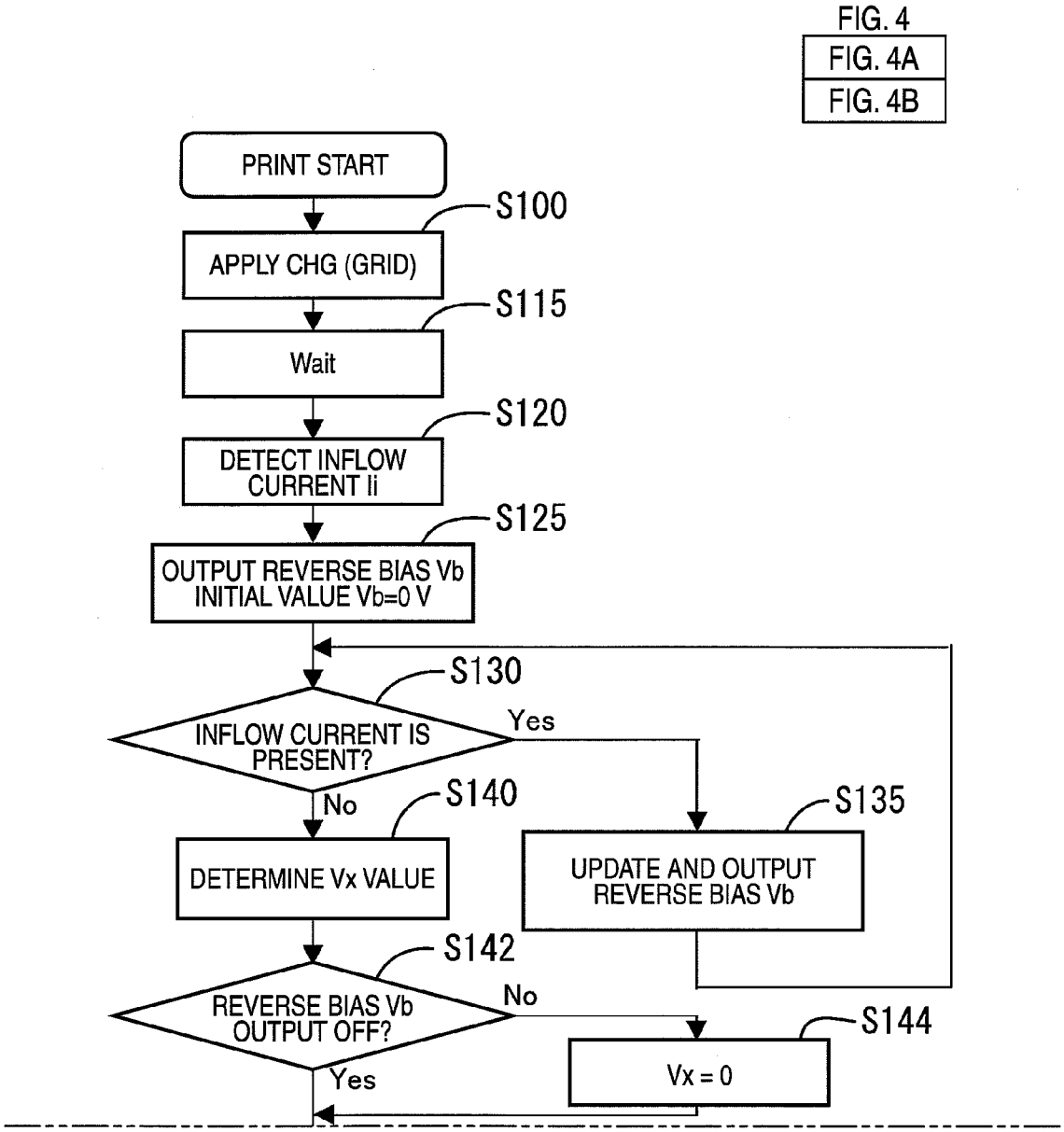
FIG. 4A and FIG. 4B are flowcharts showing details of processing according to the first embodiment.
Figure 4B:
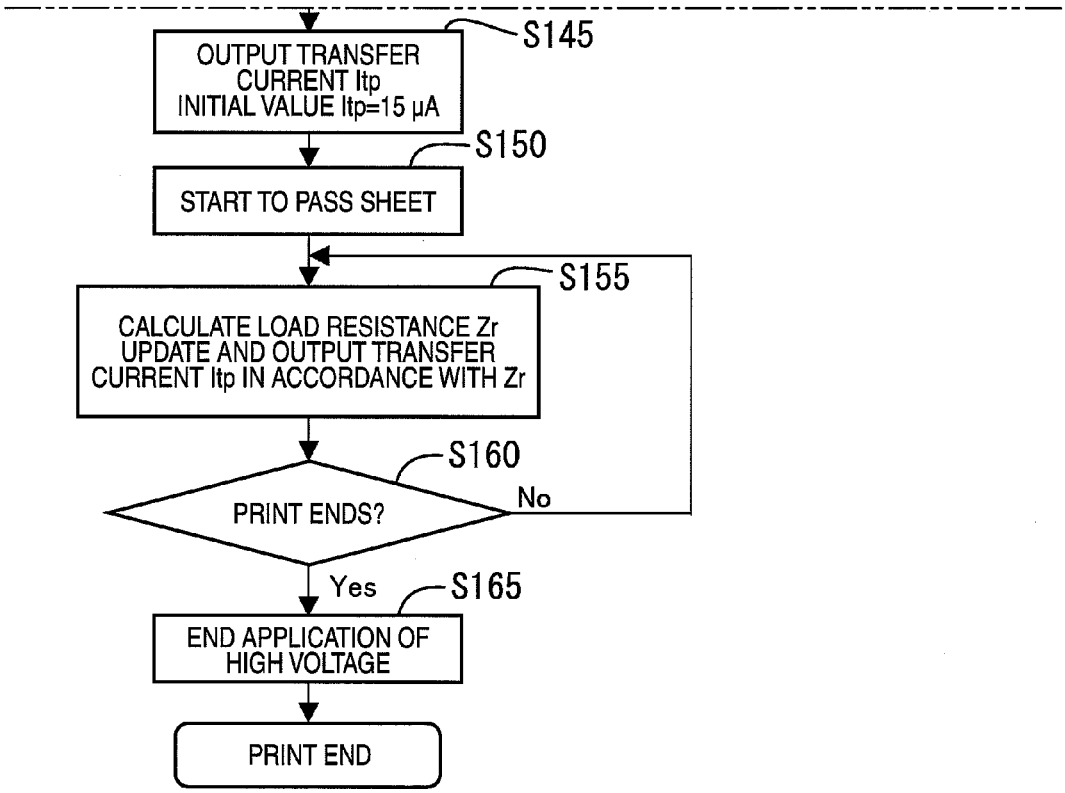

Next, a method according to this embodiment that can calculate suitable load resistance Zr and appropriately adjust the transfer current even when an inflow current Ii is present will be described with reference to FIG. 4 (FIG. 4A and FIG. 4B). Prior to this description, the inflow current Ii and load resistance Zr will be described.

Figure 3:
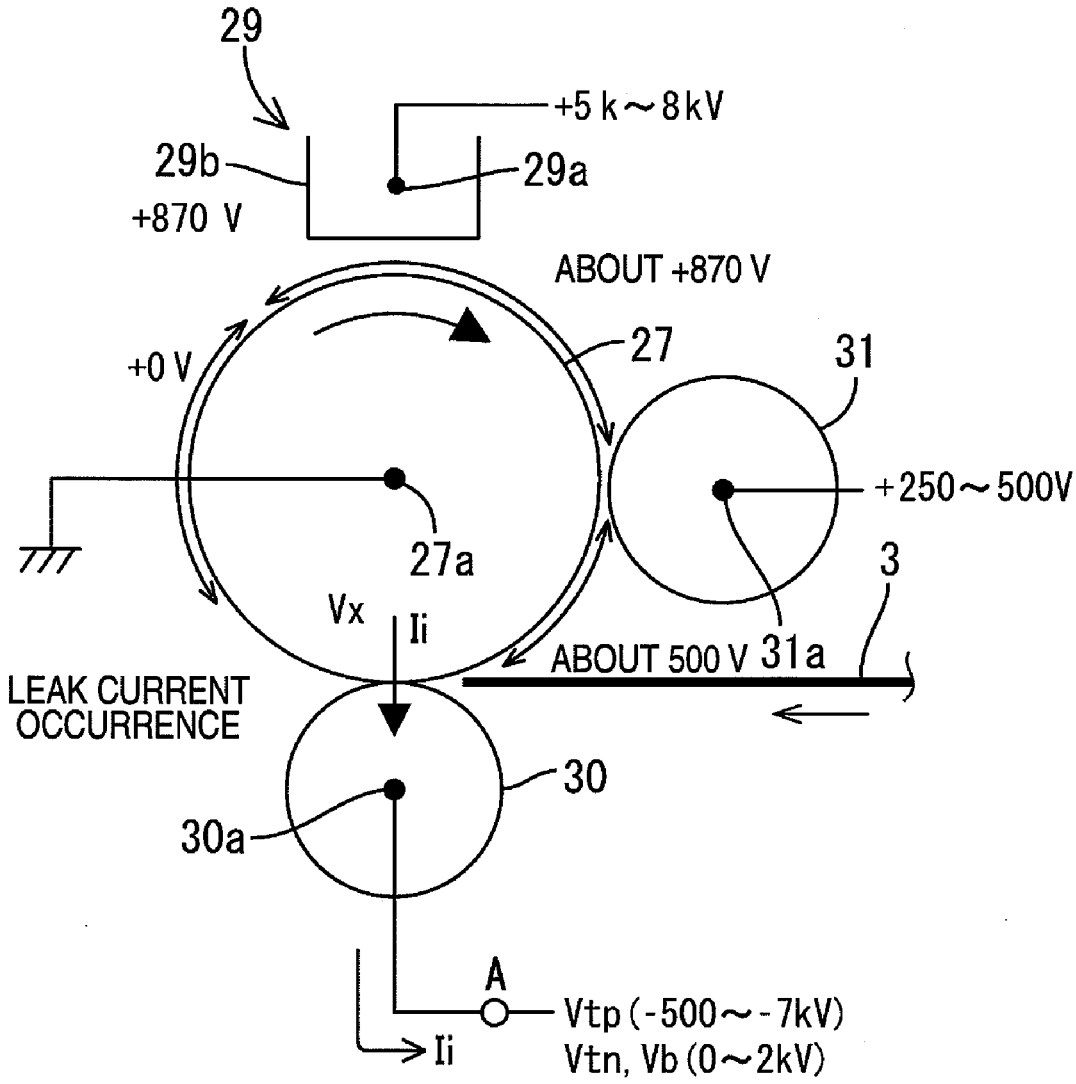
FIG. 3 is an explanatory view showing an inflow (leak) current.

In the laser printer (hereinafter, simply referred to as "printer") 1, when the toner image on the surface of the photosensitive drum 27 is transferred to the sheet 3, as described above, a predetermined forward transfer bias voltage Vtp (for example, −7 kV) is applied from the forward transfer bias application circuit 62 to the transfer roller 30. Meanwhile, when the toner image is transferred, the photosensitive drum 27 is charged with about 500 V to 870 V by the charger 29 or the developing roller 31. Accordingly, the transfer current Itp is detected in a state where the forward transfer bias voltage Vtp is applied to the transfer roller 30. However, in general, the photosensitive drum 27 is charged before the forward transfer bias voltage is applied to the transfer roller 30. Therefore, a potential (corresponds to "initiating voltage" in the invention) is generated due to charges caused by the charged photosensitive drum 27, and as shown in FIG. 3, this potential causes the inflow current Ii to flow from the photosensitive drum 27 toward the forward transfer bias application circuit 62 through the transfer roller 30 in contact with the photosensitive drum 27.

In the printer 1, as described above, the transfer current Itp is constant-current-controlled. However, load resistance Zr of the forward transfer bias application circuit 62 including the photosensitive drum 27, the transfer roller 30, and the like is changed by the effect of peripheral humidity or the like. Therefore, for example, when load resistance Zr increases, the forward transfer bias voltage Vtp increases so as to obtain a predetermined transfer current Itp. In this case, an excessive increase in the forward transfer bias voltage Vtp adversely affects a transport belt (not shown) or the like. In order to prevent this problem, load resistance Zr is calculated, and the value of the transfer current Itp under constant-current control is optimized in accordance with load resistance Zr.

In this case, load resistance Zr is calculated by using the detected forward transfer bias voltage Vtp and the detected transfer current Itp. However, the inflow current Ii affects the detected transfer current Itp, so suitable load resistance Zr is not calculated. As a result, a suitable transfer current Itp may not flow.

A method according to this embodiment that can calculate suitable load resistance Zr even when an inflow current Ii is present will be hereinafter described. That is, a method that can calculate suitable load resistance Zr and can appropriately adjust the transfer current Itp even when the inflow current Ii is included in the detected transfer current Itp will be described. FIG. 4 (FIG. 4A and FIG. 4B) is a flowchart showing details of processing related to adjustment of the transfer current according to load resistance Zr. The processing is executed by the CPU 61 in accordance with a predetermined program. In this case, the CPU 61 calculates load resistance Zr in accordance with a request for print processing (image forming processing).

If print processing starts by a print instruction of a user to the printer 1, in Step S100 of FIG. 4 (FIG. 4A and FIG. 4B), the CPU 61 applies a predetermined charging voltage (for example, 5 kV to 8 kV) to the charger 29 by using a charging voltage generation circuit (not shown) so as to charge the surface of the photosensitive drum 27 and waits for a predetermined time (see Step S115). The reason why the CPU 61 waits for a predetermined time is to stabilize the inflow current Ii.

If a predetermined waiting time elapses, in Step S120, the CPU 61 detects the inflow current Ii on the basis of the detection signal S3 detected by the detection resistor 89 in a state where the sheet 3 is not yet fed between the photosensitive drum 27 and the transfer roller 30 (image forming position). Next, in Step S125, the CPU 61 sets the initial value of the reverse bias voltage Vb at "0" V. That is, the CPU 61 causes the reverse bias application circuit 63 so as not to generate the reverse bias voltage Vb.

Next, in Step S130, the CPU 61 determines whether an inflow current Ii is present or not, that is, an inflow current Ii is detected or not (zero or not) on the basis of the detection signal S3. When the inflow current Ii is detected (Yes in Step S130), the process progresses to Step S135, and the CPU 61 adds a predetermined amount of voltage Vu to the currently set reverse bias voltage Vb. Then, the reverse bias application circuit 63 generates the increased reverse bias voltage (Vb=Vb+Vu) and applies the reverse bias voltage (Vb=Vb+Vu) to the transfer roller 30.

Next, the process returns to Step S130, and the CPU 61 determines whether or not the inflow current Ii is present even after the reverse bias voltage Vb is applied to the transfer roller 30 or not on the basis of the detection signal S3. When the inflow current Ii is detected, the process progresses to Step S135 again.

In Step S130, when the inflow current Ii is not detected (No in Step S130), in Step S140, the CPU 61 detects the value of the reverse bias voltage Vb when the inflow current Ii is not detected (the inflow current Ii is zero) on the basis of the detection signal S5 detected by the reverse bias output voltage detection circuit 83. Then, the CPU 61 determines the detected voltage value Vb as the initiating voltage Vx which induces the inflow current Ii.

Next, in Step S142, the CPU 61 determines whether or not to cut off application of the reverse bias voltage Vb. When it is determined to cut off application of the reverse bias voltage Vb (Yes), application of the reverse bias voltage Vb is cut off and the process progresses to Step S145. Meanwhile, when it is determined not to cut off application of the reverse bias voltage Vb (No), the process progresses to Step S144, the value of the initiating voltage Vx is set (determined) to be "zero", and the process progresses to Step S145. That is, when the reverse bias voltage Vb is used for determination of the initiating voltage Vx, in Step S142, application of the reverse bias voltage Vb is cut off. When application of the reverse bias voltage Vb for negating the inflow current Ii, that is, the initiating voltage Vx is continued so as to calculate load resistance Zr, in Step S142, application of the reverse bias voltage Vb is not cut off.

As described above, at the time of determination in Step S142, the use method of the reverse bias voltage Vb is selected and the calculation method of load resistance Zr is selected. An instruction for selection, that is, an instruction related to the determination in Step S142 is made, for example, by a setting switch (setting signal) to the CPU 61.

Next, in Step S145, the CPU 61 sets the initial value (reference value) of the transfer current Itp to, for example, 15 μA. In Step S150, the CPU 61 controls the registration roller 12 and the like so as to start to feed the sheet 3 to the image forming position (see FIG. 3).

In Step S155, in a state where the sheet 3 is fed to the image forming position, the CPU 61 causes the forward transfer bias application circuit 62 to generate the forward transfer bias voltage Vtp and to apply the forward transfer bias voltage Vtp to the transfer roller 30 so as to obtain the transfer current Itp as the reference value. The CPU 61 detects the forward transfer bias voltage Vtp and the transfer current Itp (substantially identical to the reference value) by the detection signal S2 and the detection signal S3. Then, load resistance Zr of the forward transfer bias application circuit 62 is calculated from Equation 1 by using the initiating voltage Vx determined in Step S140 or the initiating voltage Vx set to zero in Step S144, and the detected forward transfer bias voltage Vtp and transfer current Itp. The load includes the photosensitive drum 27, the sheet 3, the transfer roller 30, and the like. When an inflow current Ii is present, the inflow current Ii is included in the detected transfer current Itp.

$$Zr=(-Vtp+Vx)/Itp \qquad \text{Equation 1}$$

That is, in this embodiment, when load resistance Zr is calculated, a component of the inflow current Ii is introduced as the initiating voltage (Vx=Zr*Ii). Therefore, load resistance Zr can be accurately calculated even when the inflow current Ii is present, or in accordance with the magnitude of the inflow current Ii.

The CPU 61 updates the value of the transfer current Itp under constant-current control from the reference value, for example, 15 μA to a value corresponding to the calculated load resistance Zr in accordance with table data indicating a relationship between the calculated load resistance Zr and the transfer current Itp. Table data is stored in, for example, the memory 100. Therefore, even when load resistance Zr is changed depending on peripheral humidity during the print processing, a suitable transfer current Itp according to the change can be set.

When the toner image is transferred to the sheet 3, the CPU 61 controls the forward transfer bias application circuit 62 such that an updated transfer current Itp is obtained.

Next, in Step S160, it is determined whether or not the print processing by a print instruction ends. When it is determined that the print processing does not end (No in Step S160), the process returns to Step S155 and Steps S155 to S160 are repeated. When it is determined that the print processing ends (Yes in Step S160), in Step S165, the CPU 61 ends application of a high voltage related to print by the bias application circuit 60. Thus, the print processing ends.

Advantages of First Embodiment

In the first embodiment, load resistance Zr of the forward transfer bias application circuit 62 is calculated taking into consideration the inflow current Ii from the photosensitive drum 27 to the forward transfer bias application circuit 62. The transfer current Itp is adjusted in accordance with the calculated load resistance Zr. Therefore, load resistance Zr of the forward transfer bias application circuit 62 can be accurately calculated even when an inflow current Ii is present, or in accordance with the magnitude of the inflow current Ii. As a result, even when an inflow current Ii from the photosensitive drum 27 to the forward transfer bias application circuit 62 is present, the transfer current Itp can be appropriately adjusted.

The initiating voltage Vx of the inflow current Ii is determined by the value of the reverse bias voltage Vb completely negating the inflow current Ii. In this case, the reverse bias application circuit 63 that generates the reverse bias voltage Vb is provided so as to remove toner stuck to the transfer roller 30. Therefore, the initiating voltage Vx can be appropriately determined by using existing configuration, without adding any new configuration.

The CPU 61 calculates load resistance Zr in accordance with a request for print processing. Therefore, the print processing can be performed on the basis of the accurate load resistance Zr, that is, the accurate transfer current Itp, and even when the inflow current Ii (load resistance Zr) is changed depending on humidity or the like, desired print quality can be maintained.

Second Embodiment

Figure 5A:
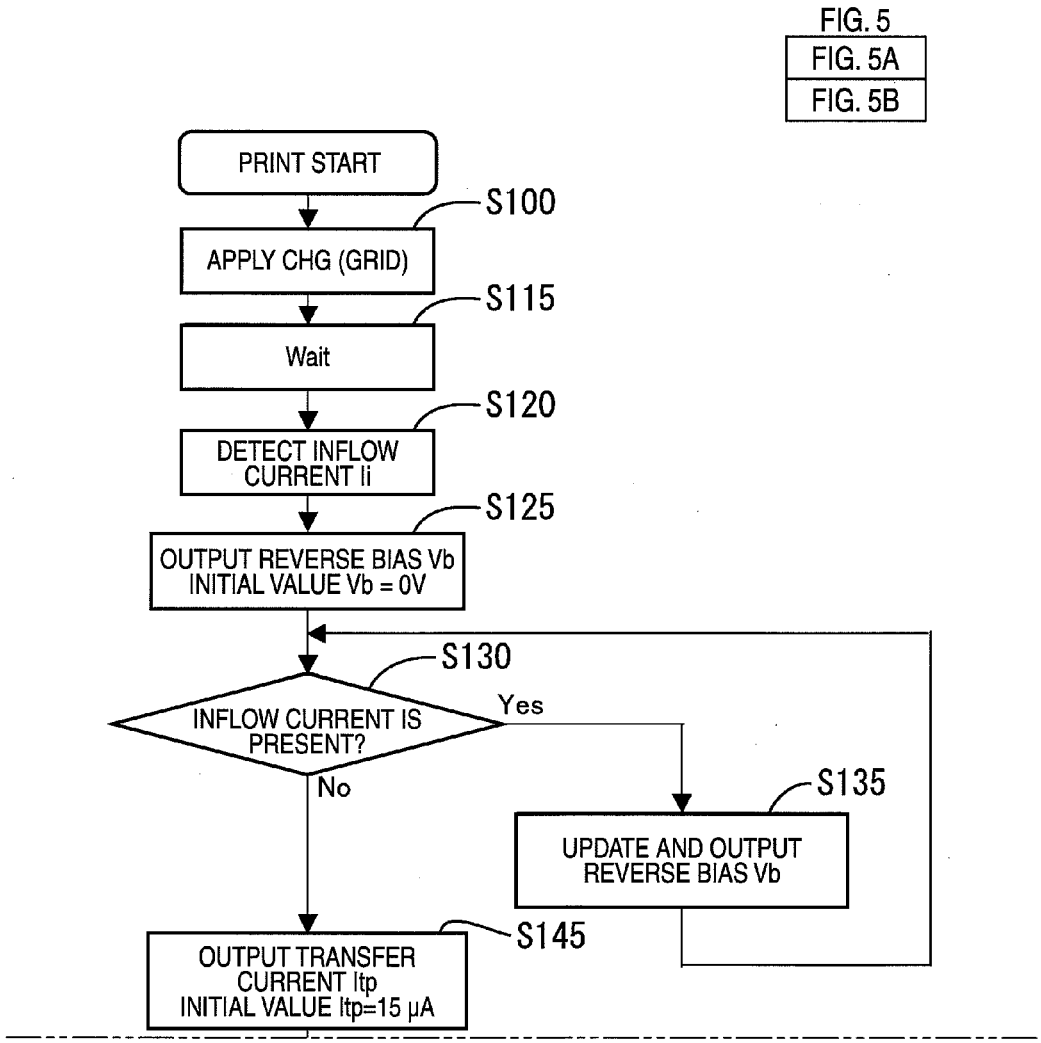
FIG. 5A and FIG. 5B are flowcharts showing details of processing according to a second embodiment.
Figure 5B:
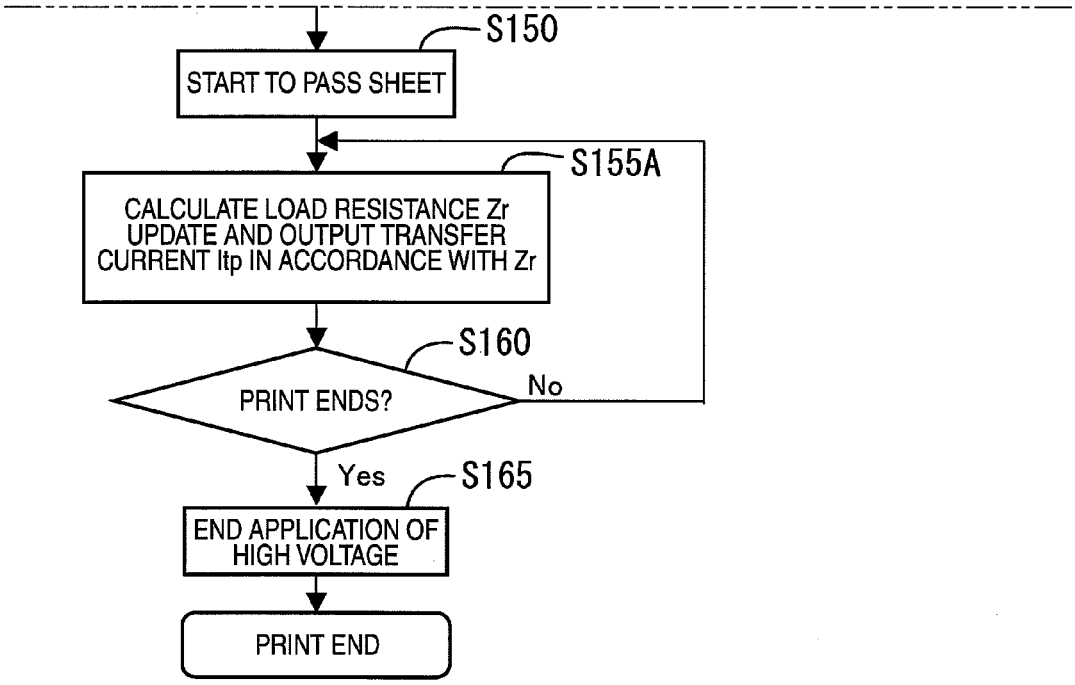

A second embodiment of the invention will be described with reference to FIG. 5 (FIG. 5A and FIG. 5B). FIG. 5 (FIG. 5A and FIG. 5B) is a flowchart showing processing related to adjustment of the transfer current Itp based on load resistance Zr according to the second embodiment. The processing of FIG. 5 (FIG. 5A and FIG. 5B) is executed by the CPU (an example of a control unit) 61 in accordance with a predetermined program, similarly to the first embodiment. In FIG. 5 (FIG. 5A and FIG. 5B), the same steps as those in the flowchart of FIG. 4 (FIG. 4A and FIG. 4B) related to the first embodiment are represented by the same step numbers, and descriptions thereof will not be repeated. Only a difference from the first embodiment will be described.

A difference from the first embodiment is that, in the adjustment of the transfer current Itp based on load resistance Zr, the processing for determining the initiating voltage Vx is removed. Specifically, in the determination in Step S130 of FIG. 5 (FIG. 5A and FIG. 5B), when the inflow current Ii is not detected (No), the process progresses to Step S145. That is, Steps S140, S142, and S144 of FIG. 4 (FIG. 4A and FIG. 4B) are removed.

In Step S155A, the CPU 61 calculates load resistance Zr from Equation 2 by using the forward transfer bias voltage Vtp detected by the forward transfer output voltage detection circuit 73 and the transfer current Itp detected by the current detection circuit 84 in a state where the reverse bias voltage Vb negating the inflow current Ii is applied to the transfer roller 30.

$$Zr=-Vtp/Itp \qquad \text{Equation 2}$$

Next, after Step S160, the CPU 61 executes the same processing as the first embodiment.

Advantages of Second Embodiment

As described above, in the second embodiment, calculation of load resistance Zr is performed in a state where the inflow current Ii is negated by application of the reverse bias voltage Vb to the transfer roller 30. Therefore, even when the inflow current Ii is present, load resistance Zr can be appropriately calculated with no influence of the inflow current Ii. In this case, the processing for determining the initiating voltage Vx is removed, so processing related to calculation of load resistance Zr is simplified, as compared with the first embodiment.

Third Embodiment

Figure 6:
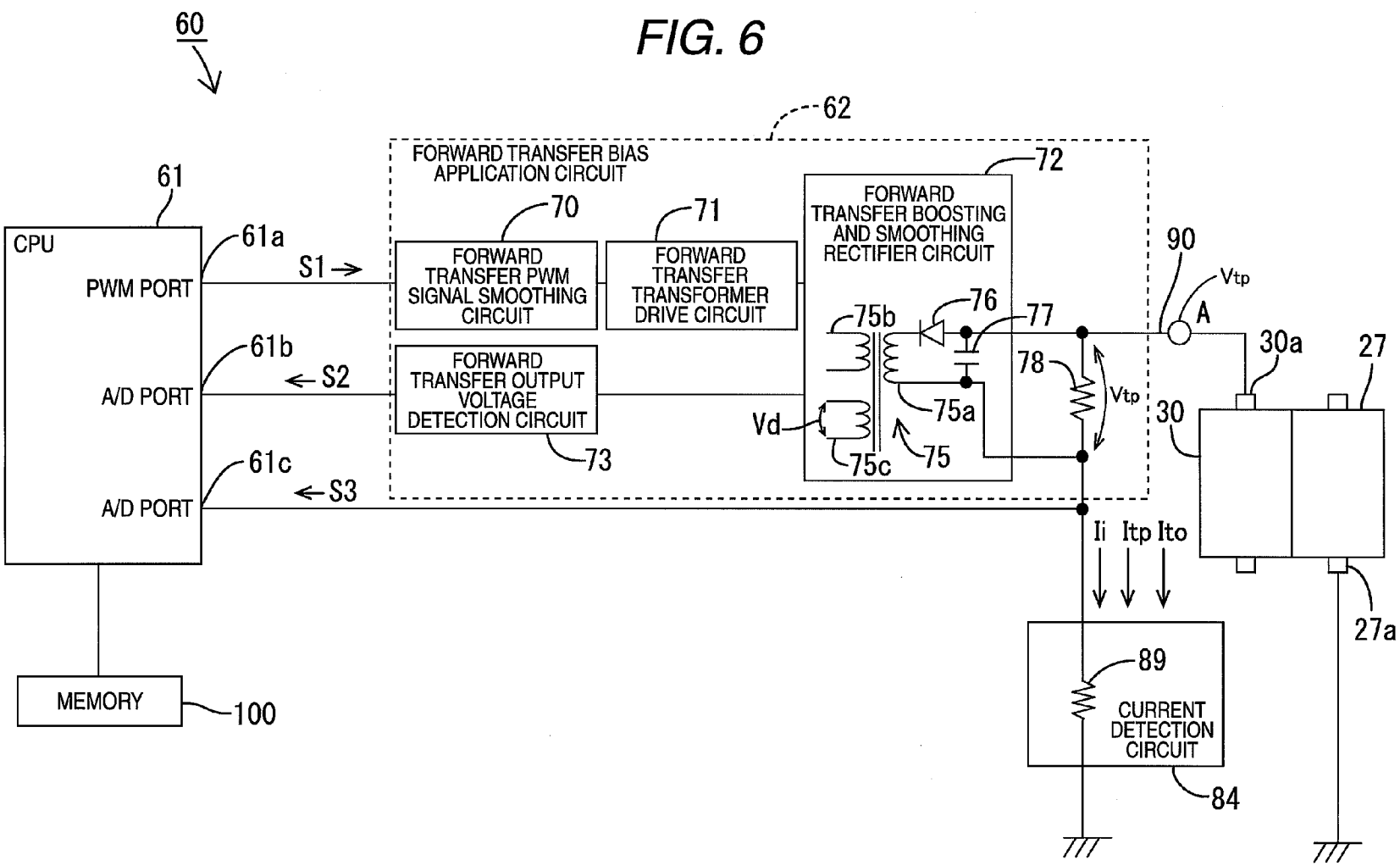
FIG. 6 is a block diagram showing the configuration of main parts of a bias application circuit according to a third embodiment of the invention.

A third embodiment of the invention will be described with reference to FIGS. 6 and 7. FIG. 6 is a block diagram showing the configuration of main parts of a bias application circuit 60A according to the third embodiment. The bias application circuit 60A of the third embodiment is not provided with the bias application circuit 60 to the reverse bias application circuit 63 of the first embodiment, thus detailed descriptions thereof will be omitted.

Figure 7A:
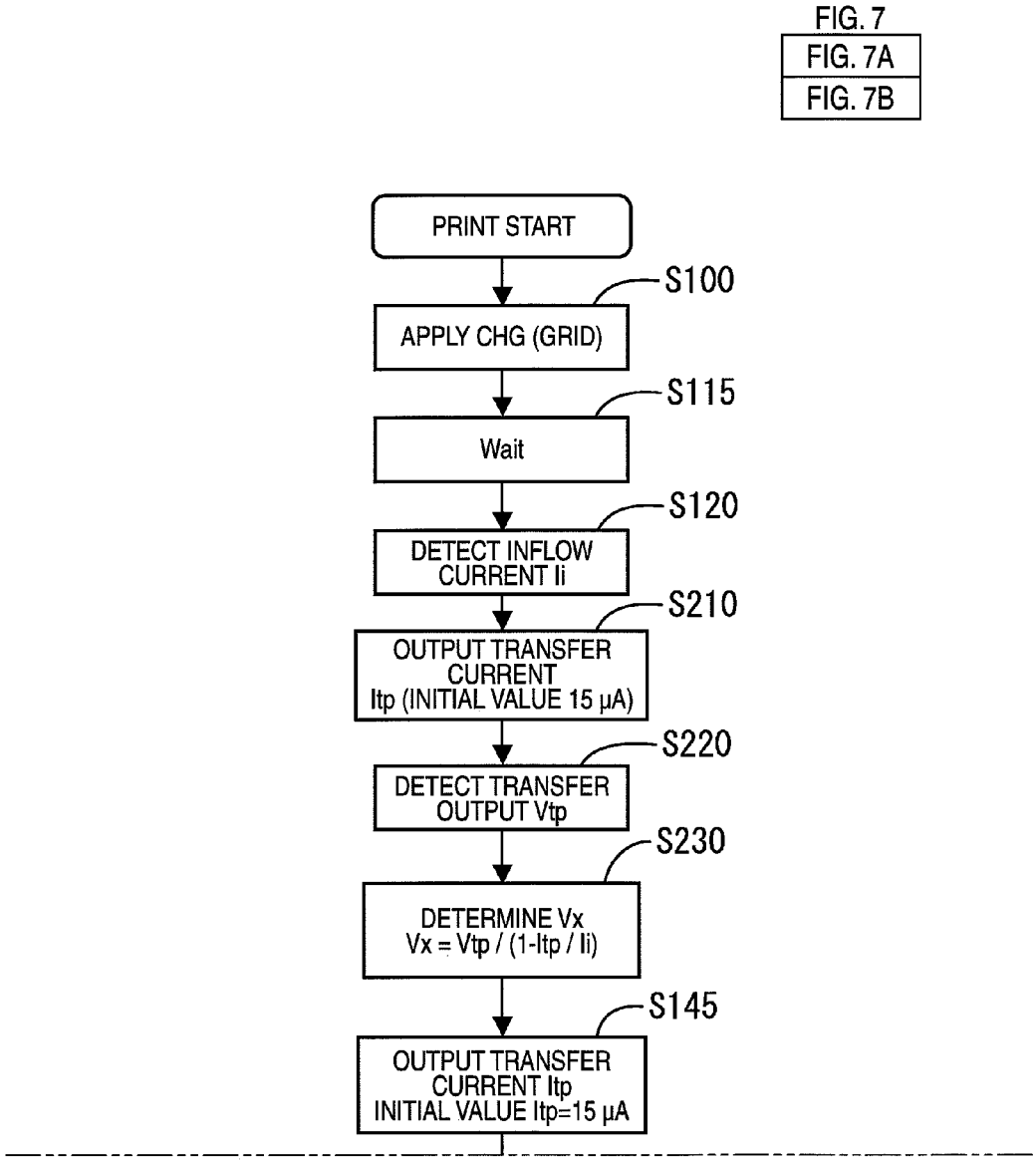
FIG. 7A and FIG. 7B are flowcharts showing details of processing according to the third embodiment.
Figure 7B:
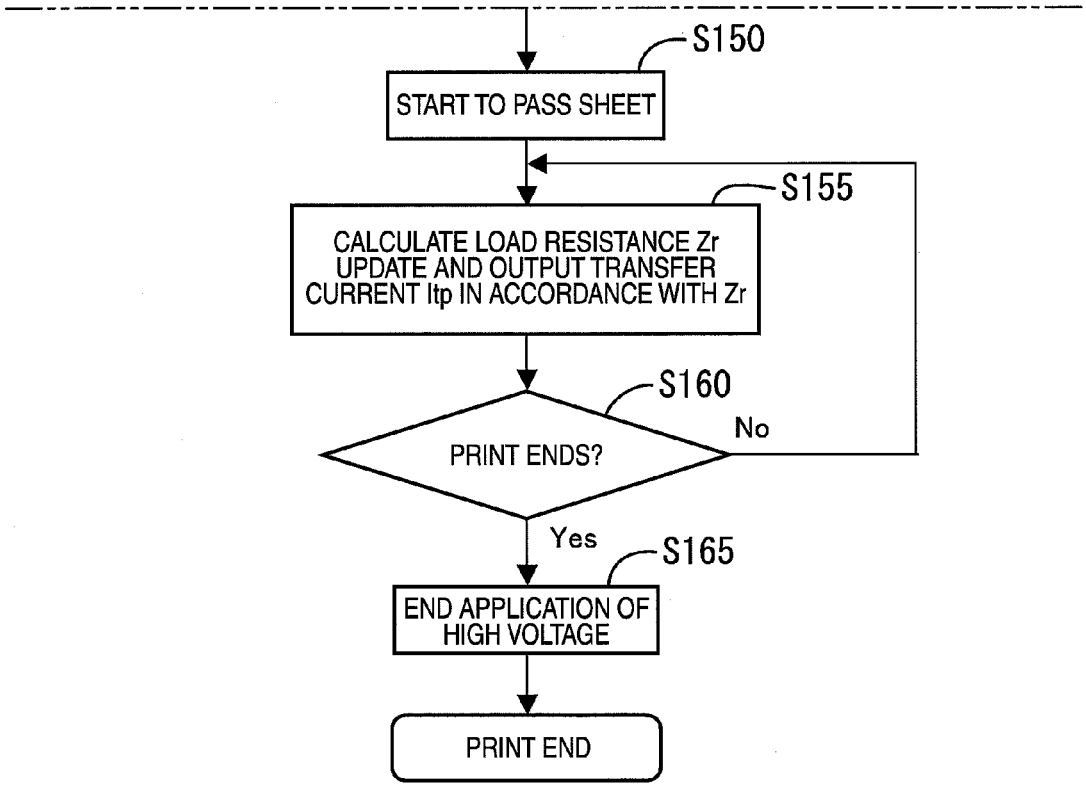

FIG. 7 (FIG. 7A and FIG. 7B) is a flowchart showing processing related to adjustment of the transfer current Itp based on load resistance Zr according to the third embodiment. The processing of FIG. 7 (FIG. 7A and FIG. 7B) is executed by the CPU 61 in accordance with a predetermined program, similarly to the first embodiment. In FIG. 7 (FIG. 7A and FIG. 7B), the same steps as those in the flowchart of FIG. 4 (FIG. 4A and FIG. 4B) related to the first embodiment are represented by the same step numbers, and descriptions thereof will not be repeated. Only a difference from the first embodiment will be described. The overall configuration of the printer 1 is the same as in the first embodiment, and thus a description thereof will not be repeated.

A difference between the first embodiment and the third embodiment is a method of determining the initiating voltage Vx. That is, in the third embodiment, the initiating voltage Vx is determined by using the transfer voltage Vtp, the inflow current Ii, and the transfer current Itp detected in a state where the sheet 3 is not fed between the photosensitive drum 27 and the transfer roller 30 (image forming position).

In Step S120 of the flowchart of FIG. 7 (FIG. 7A and FIG. 7B), the CPU 61 first detects the inflow current Ii in a state where the sheet 3 is not fed to the image forming position. In Step S210, in the same state, the CPU 61 controls the forward transfer bias application circuit 62 to output a transfer output current Ito by application of the transfer voltage Vtp. Then, the transfer current Itp including the inflow current Ii and the transfer output current Ito is detected. The output current Ito is output such that the transfer current Itp becomes the initial value, that is, 15 μA.

In Step S220, in the same state, the CPU 61 detects the transfer voltage Vtp. In this case, as shown in FIG. 6, the inflow current Ii and the transfer current Itp are detected on the basis of the detection signal S3 through the current detection circuit 84. The transfer voltage Vtp is detected on the basis of the detection signal S2 through the forward transfer output voltage detection circuit 73.

Next, in Step S230, the CPU 61 calculates the initiating voltage Vx from Equation 3 by using the detected transfer voltage Vtp, the inflow current Ii, and the transfer current Itp. That is, in the third embodiment, the CPU 61 determines the initiating voltage Vx by calculation.

$$Vx=Vtp/(1-Itp/Ii) \quad \text{Equation 3}$$

Equation 3 is derived from Equations 4 and 5.

When load resistance is Zr, the following relationship is established.

$$Zr=(-Vtp+Vx)/Itp \quad \text{Equation 4}$$

Further, as described above, the following relationship is established.

$$Vx=Zr*Ii \quad \text{Equation 5}$$

If Equation 5 is substituted into Equation 4, Equation 3 is derived.

Specifically, the transfer output current Ito generated by application of the transfer voltage Vtp, the inflow current Ii, and the detected transfer current Itp have the relationship expressed by Equation 6.

$$Itp=Ito+Ii \quad \text{Equation 6}$$

That is, the value of the transfer current Itp detected by the current detection circuit 84 when the transfer voltage Vtp is applied to the transfer roller 30 includes the value of the inflow current Ii. When the inflow current Ii is absent, the transfer current Itp and the transfer output current Ito are identical.

Next, after Step S230, the CPU 61 executes Steps S145 to S165, similarly to the first embodiment.

Advantages of Third Embodiment

In the third embodiment, the initiating voltage Vx is calculated by using the transfer voltage Vtp detected by the forward transfer output voltage detection circuit 73 and the inflow current Ii and the transfer current Itp detected by the current detection circuit 84. In this case, the forward transfer output voltage detection circuit 73 and the current detection circuit 84 have the existing configuration. Therefore, the initiating voltage Vx can be easily determined by calculation without adding any new configuration, that is, without causing an increase in costs due to the addition of any configuration.

Other Embodiments

The invention is not limited to the embodiments described in the above description and the drawings, and the following embodiments still fall within the technical scope of the invention.

(1) In the foregoing embodiments, an example where the same current detection circuit 84 forms a transfer current detection unit and an inflow current detection unit in the invention has been described, but the invention is not limited thereto. The transfer current Itp and the inflow current Ii may be respectively detected by a transfer current detection unit and an inflow current detection unit provided separately.

(2) In the first and second embodiments, an example where, when the initiating voltage Vx is determined, in Step S130 of FIG. 4 (FIG. 4A and FIG. 4B), it is determined whether an inflow current Ii is present, that is, whether an inflow current Ii is detected or not (zero or not) has been described, but the invention is not limited thereto.

When the inflow current Ii is equal to or larger than a predetermined value, control may be performed such that the reverse voltage Vb gradually increases, and when the inflow current Ii becomes smaller than the predetermined value as the reverse voltage Vb increases, and the reverse voltage Vb at that time may be determined as a voltage value for determining the initiating voltage Vx or for negating the initiating voltage Vx.

With this configuration, a predetermined value of the inflow current Ii may be set to a value having no influence on image formation, and the initiating voltage Vx may be appropriately determined by the value of the reverse voltage Vb negating the inflow current Ii to the predetermined value. Alternatively, the reverse voltage Vb may be determined as a voltage value for negating the initiating voltage Vx.

(3) During the processing subsequent Step S140 of the first embodiment, processing for cutting off output of the reverse bias Vb may be performed, in place of Steps S142 and S144. That is, the reverse bias Vb may be used in the determination of the initiating voltage Vx, and the reverse bias Vb may be cut off after the initiating voltage Vx is determined.

(4) The determination of the initiating voltage Vx in the third embodiment may be executed by using the bias application circuit 60 having the reverse bias application circuit 63 according to the first embodiment. In this case, the determination of the initiating voltage Vx in the third embodiment may be executed only by using the forward transfer bias application circuit 62 of the bias application circuit 60 according to the first embodiment.

According to a first aspect of the present invention, there is provided an image forming apparatus comprising: an image carrying unit that carries an image developed by a developer; a charging unit that charges the image carrying unit; a transfer unit that transfers the image to a recording medium in accordance with application of a transfer voltage; an application unit that generates the transfer voltage and applies the transfer voltage to the transfer unit; a voltage detection unit that detects the transfer voltage; an inflow current detection unit that detects an inflow current flowing from the image carrying unit charged by the charging unit into the application unit; a transfer current detection unit that detects a transfer current flowing when the transfer voltage is applied to the transfer unit; a determination unit that determines an initiating voltage which induces the inflow current; a calculation unit that calculates load resistance of the application unit based on the transfer voltage detected by the voltage detection unit, the transfer current detected by the transfer current detection unit, and the initiating voltage determined by the determination unit; and an adjustment unit that adjusts the transfer current in accordance with the load resistance calculated by the calculation unit.

With this configuration, load resistance of the application unit is calculated taking into consideration an inflow current caused by the charged image carrying unit. A transfer current is adjusted depending on the inflow current. Therefore, load resistance of the application unit can be accurately calculated even when an inflow current is present or in accordance with the magnitude of the inflow current. As a result, even when an inflow current from the image carrying unit to the application unit is present, the transfer current can be appropriately adjusted.

The direction of the inflow current includes the direction from the application unit to the image carrying unit through the transfer unit, as well as the direction from the image carrying unit to the application unit through the transfer unit. The term "initiation voltage" means a potential of the image carrying unit caused by the charged electric charges in a circuit loop for calculating load resistance.

According to a second aspect of the present invention, in addition to the first aspect, the determination unit calculates the initiating voltage based on the transfer voltage, the inflow current, and the transfer current which are detected in a state in which the recording medium is not fed between the image carrying unit and the transfer unit.

With this configuration, the initiation voltage is calculated by using the transfer voltage, the inflow current, and the transfer current detected by the voltage detection unit and the respective current detection units. In this case, existing configuration can be used as the voltage detection unit and the current detection units, so the initiation voltage can be easily determined by calculation without adding any new configuration, that is, without causing an increase in costs due to the addition of any configuration.

According to a third aspect of the present invention, in addition to the first aspect, the image forming apparatus further comprising: a reverse voltage application unit that applies a reverse voltage having a polarity opposite to the transfer voltage to the transfer unit, wherein, in a state where the recording medium is not fed between the image carrying unit and the transfer unit, when the inflow current is equal to or larger than a predetermined value, the determination unit controls the reverse voltage application unit so as to gradually increase the reverse voltage, and when the inflow current becomes smaller than the predetermined value as the reverse voltage increases, the determination unit determines the reverse voltage at that time as the initiating voltage.

With this configuration, the initiation voltage of the inflow current can be determined by the value of a reverse voltage negating an inflow current to be less than a predetermined value, for example, to be less than a value having no influence on image formation. The reverse voltage application unit may be provided so as to remove toner stuck to the transfer unit. In this case, the reverse voltage application unit can be appropriately used to determine the initiation voltage.

According to a fourth aspect of the present invention, in addition to the third aspect, when the inflow current becomes zero as the reverse voltage increases, the determination unit determines the reverse voltage at that time as the initiating voltage and controls the reverse voltage application unit so as to cut off the reverse voltage.

With this configuration, the initiation voltage of the inflow current is determined by the value of a reverse voltage completely negating an inflow current, so an influence of the inflow current at the time of calculation of load resistance can be further suppressed.

According to a fifth aspect of the present invention, in addition to the first aspect, the image forming apparatus further comprises a reverse voltage application unit that applies a reverse voltage having a polarity opposite to the transfer voltage to the transfer unit, wherein, in a state where the recording medium is not fed between the image carrying unit and the transfer unit, when the inflow current is equal to or larger than a predetermined value, the determination unit controls the reverse voltage application unit so as to gradually increase the reverse voltage, and when the inflow current becomes smaller than the predetermined value as the reverse voltage increases, the determination unit controls the reverse voltage application unit so as to maintain a state where the reverse voltage is applied, and the calculation unit calculates the load resistance in a state where the reverse voltage is applied such that the inflow current becomes smaller than the predetermined value by the determination unit.

With this configuration, calculation of load resistance is performed in a state where a reverse voltage negating an inflow current to be less than a predetermined value, for example, to be less than a value having no influence on image formation is applied to the transfer unit. Therefore, even when an inflow current is present, load resistance can be appropriately calculated with no influence of the inflow current.

According to a sixth aspect of the present invention, in addition to the fifth aspect, when the inflow current becomes zero as the reverse voltage increases, the determination unit determines that the initiating voltage is zero and controls the reverse voltage application unit so as to maintain a state where the reverse voltage at that time is applied.

With this configuration, calculation of load resistance is performed in a state where a reverse voltage completely negating an inflow current is applied to the transfer unit. Therefore, an influence of the inflow current at the time of calculation of load resistance can be further suppressed.

According to a seventh aspect of the present invention, there is provided an image forming apparatus comprising: an image carrying unit that carries an image developed by a developer; a charging unit that charges the image carrying unit; a transfer unit that transfers the image to a recording medium in accordance with application of a transfer voltage; an application unit that generates the transfer voltage and applies the transfer voltage to the transfer unit; a voltage detection unit that detects the transfer voltage; an inflow current detection unit that detects an inflow current flowing from the image carrying unit charged by the charging unit into the application unit; a transfer current detection unit that detects a transfer current flowing when the transfer voltage is applied to the transfer unit; a reverse voltage application unit that applies a reverse voltage having a polarity opposite to the transfer voltage to the transfer unit; a control unit that controls the reverse voltage application unit so as to gradually increase the reverse voltage when the inflow current is equal to or larger than a predetermined value in a state where the recording medium is not fed between the image carrying unit and the transfer unit, and when the inflow current becomes smaller than the predetermined value as the reverse voltage increases, the control unit controls the reverse voltage application unit so as to maintain a state where the reverse voltage is applied; a calculation unit that calculates load resistance of the application unit based on the transfer voltage detected by the voltage detection unit and the transfer current detected by the transfer current detection unit, the calculation unit calculating the load resistance in a state where the reverse voltage is applied by the control unit such that the inflow current becomes smaller than the predetermined value; and an adjustment unit that adjusts the transfer current in accordance with the load resistance calculated by the calculation unit.

With this configuration, calculation of load resistance is performed in a state where a reverse voltage negating an inflow current to be less than a predetermined value, for example, to be less than a value having no influence on image formation is applied to the transfer unit. Therefore, even when an inflow current is present, load resistance can be appropriately calculated with no influence of the inflow current. As a result, even when an inflow current from the image carrying unit to the application unit is present, the transfer current can be appropriately adjusted.

According to an eighth aspect of the present invention, in addition to the seventh aspect of the present invention, when the inflow current becomes zero as the reverse voltage increases, the control unit controls the reverse voltage application unit so as to maintain a state where the reverse voltage at that time is applied.

With this configuration, calculation of load resistance is performed in a state where a reverse voltage completely negating an inflow current is applied to the transfer unit. Therefore, an influence of the inflow current at the time of calculation of load resistance can be further suppressed.

According to a ninth aspect of the present invention, in addition to the first aspect or the seventh aspect, the calculation unit calculates the load resistance in accordance with a request for image forming processing.

With this configuration, load resistance is calculated every time image forming processing is required. Therefore, image forming processing can be performed on the basis of accurate load resistance, and even when an inflow current is changed due to humidity or the like, desired image quality can be maintained.

What is claimed is:

1. An image forming apparatus comprising:

an image carrying unit configured to carry an image developed by a developer;

a charging unit configured to charge the image carrying unit;

a transfer unit configured to transfer the image to a recording medium in accordance with application of a transfer voltage;

an application unit configured to generate the transfer voltage and apply the transfer voltage to the transfer unit;

a voltage detection unit configured to detect the transfer voltage;

an inflow current detection unit configured to detect an inflow current flowing from the image carrying unit charged by the charging unit into the application unit;

a transfer current detection unit configured to detect a transfer current flowing when the transfer voltage is applied to the transfer unit;

a determination unit configured to determine an initiating voltage which induces the inflow current;

a calculation unit configured to calculate load resistance of the application unit based on the transfer voltage detected by the voltage detection unit, the transfer current detected by the transfer current detection unit, and the initiating voltage determined by the determination unit;

an adjustment unit configured to adjust the transfer current in accordance with the load resistance calculated by the calculation unit; and a reverse voltage application unit configured to apply a reverse voltage having a polarity opposite to the transfer voltage to the transfer unit, wherein, in a state where the recording medium is not fed between the image carrying unit and the transfer unit, when the inflow current is equal to or larger than a predetermined value, the determination unit controls the reverse voltage application unit so as to gradually increase the reverse voltage, and when the inflow current becomes smaller than the predetermined value as the reverse voltage increases, the determination unit determines the reverse voltage at that time as the initiating voltage.

2. The image forming apparatus according to claim 1, wherein the determination unit calculates the initiating voltage based on the transfer voltage, the inflow current, and the transfer current which are detected in a state in which the recording medium is not fed between the image carrying unit and the transfer unit.

3. The image forming apparatus according to claim 1, wherein, when the inflow current becomes zero as the reverse voltage increases, the determination unit determines the reverse voltage at that time as the initiating voltage and controls the reverse voltage application unit so as to cut off the reverse voltage.

4. An image forming apparatus comprising:

an image carrying unit configured to carry an image developed by a developer;

a charging unit configured to charge the image carrying unit;

a transfer unit configured to transfer the image to a recording medium in accordance with application of a transfer voltage;

an application unit configured to generate the transfer voltage and apply the transfer voltage to the transfer unit;

a voltage detection unit configured to detect the transfer voltage;

an inflow current detection unit configured to detect an inflow current flowing from the image carrying unit charged by the charging unit into the application unit;

a transfer current detection unit configured to detect a transfer current flowing when the transfer voltage is applied to the transfer unit;

a determination unit configured to determine an initiating voltage which induces the inflow current;

a calculation unit configured to calculate load resistance of the application unit based on the transfer voltage detected by the voltage detection unit, the transfer current detected by the transfer current detection unit, and the initiating voltage determined by the determination unit an adjustment unit configured to adjust the transfer current in accordance with the load resistance calculated by the calculation unit; and a reverse voltage application unit configured to apply a reverse voltage having a polarity opposite to the transfer voltage to the transfer unit, wherein, in a state where the recording medium is not fed between the image carrying unit and the transfer unit, when the inflow current is equal to or larger than a predetermined value, the determination unit controls the reverse voltage application unit so as to gradually increase the reverse voltage, and when the inflow current becomes smaller than the predetermined value as the reverse voltage increases, the determination unit controls the reverse voltage application unit so as to maintain a state where the reverse voltage is applied, and the calculation unit calculates the load resistance in a state where the reverse voltage is applied such that the inflow current becomes smaller than the predetermined value by the determination unit.

5. The image forming apparatus according to claim 4, wherein, when the inflow current becomes zero as the reverse voltage increases, the determination unit determines that the initiating voltage is zero and controls the reverse voltage application unit so as to maintain a state where the reverse voltage at that time is applied.

6. An image forming apparatus comprising:

an image carrying unit configured to carry an image developed by a developer;

a charging unit configured to charge the image carrying unit;

a transfer unit configured to transfer the image to a recording medium in accordance with application of a transfer voltage;

an application unit configured to generate the transfer voltage and apply the transfer voltage to the transfer unit;

a voltage detection unit configured to detect the transfer voltage;

an inflow current detection unit configured to detect an inflow current flowing from the image carrying unit charged by the charging unit into the application unit;

a transfer current detection unit configured to detect a transfer current flowing when the transfer voltage is applied to the transfer unit;

a reverse voltage application unit configured to apply a reverse voltage having a polarity opposite to the transfer voltage to the transfer unit;

a control unit configured to control the reverse voltage application unit so as to gradually increase the reverse voltage when the inflow current is equal to or larger than a predetermined value in a state where the recording medium is not fed between the image carrying unit and the transfer unit, and when the inflow current becomes smaller than the predetermined value as the reverse voltage increases, the control unit controls the reverse voltage application unit so as to maintain a state where the reverse voltage is applied;

a calculation unit configured to calculate load resistance of the application unit based on the transfer voltage detected by the voltage detection unit and the transfer current detected by the transfer current detection unit, the calculation unit calculating the load resistance in a state where the reverse voltage is applied by the control unit such that the inflow current becomes smaller than the predetermined value; and an adjustment unit configured to adjust the transfer current in accordance with the load resistance calculated by the calculation unit.

7. The image forming apparatus according to claim 6, wherein, when the inflow current becomes zero as the reverse voltage increases, the control unit controls the reverse voltage application unit so as to maintain a state where the reverse voltage at that time is applied.

8. The image forming apparatus according to claim 1, wherein the calculation unit calculates the load resistance in accordance with a request for image forming processing.

9. The image forming apparatus according to claim 6, wherein the calculation unit calculates the load resistance in accordance with a request for image forming processing.

* * * * *